United States Patent [19]

Yang

[11] Patent Number: 4,833,754

[45] Date of Patent: May 30, 1989

[54] SUPPORTING BRACKET FOR WINDOWS

[76] Inventor: Wu N. Yang, 2nd Fl., No. 7, Alley 44, Kinmen St., Taipei, Taiwan

[21] Appl. No.: 248,957

[22] Filed: Sep. 26, 1988

[51] Int. Cl.[4] ..... E05D 11/08

[52] U.S. Cl. ..... 16/339; 16/337; 16/363; 16/364; 16/DIG. 16; 16/371; 16/369; 49/252; 49/251

[58] Field of Search ..... 16/271, 272, 369, 371, 16/374, 375, 337, 338, 339, 340, 363, 364, DIG. 16, DIG. 17; 292/263, 338; 49/250, 251, 252, 260

[56] References Cited

U.S. PATENT DOCUMENTS

| | | | |
|---|---|---|---|
| 2,932,848 | 4/1960 | Ahlgren | 16/338 |
| 3,345,777 | 10/1967 | Anderberg . | |
| 3,903,949 | 9/1975 | Aris | 49/250 |
| 4,571,776 | 2/1986 | Taylor | 16/363 |

FOREIGN PATENT DOCUMENTS

| | | | |
|---|---|---|---|
| 2047309 | 11/1980 | United Kingdom | 49/251 |

*Primary Examiner*—Nicholas P. Godici
*Assistant Examiner*—Edward A. Brown
*Attorney, Agent, or Firm*—Bacon & Thomas

[57] ABSTRACT

A supporting bracket including a track member, a slide, a stop member, a sash arm, a short link, a strut and a brace. The track member has a pair of folded side flanges along the length thereof with at least one of the folded side flanges which is subject to face toward a window sash being discontinuous at a central part thereof to define a cutout part; and a boss provided with a pivot pin having a central groove and a C-ring. The slide is movable along the track member and has a length substantially equal to the length of the cutout part. The stop member is secured to the track member and has a button shape with a central groove and a flattened portion. The stop member is turnable to a position with its rounded portion facing the slide to keep the slide within the side flanges and is turnable to a position with its flatten portion facing the slide such that the slide is releasable from the track member at the cutout part.

3 Claims, 6 Drawing Sheets

SUPPORTING BRACKET FOR WINDOWS

BACKGROUND OF THE INVENTION

The present invention relates to supporting brackets for windows, more particularly, to supporting brackets which are arranged to support a window for pivotal movement about either a vertical or a horizontal axis; the bracket being arranged in a detachable manner such that the bracket can be mounted or dismounted from a window frame readily for cleaning or other purposes.

Heretofore, various kinds of supporting brackets for windows have been designed to meet the needs of the market, especially the supporting bracket which is adapted to be employed for the support of casement type windows or transom type windows, that is, for the support of windows to permit their pivotal movement about a vertical axis or a horizontal axis, and is adapted to be connected between a conventional window frame and window sash, whether these structures be formed of metal or wood.

U.S. Pat. No. 3,345,777 to Anderberg et al issued Oct. 10, 1967 discloses a bracket which is arranged to cause the pivotal axis of a window to move to and from the window frame so that when the window is open, both surfaces are accessible from the inner side of the window and is so arranged as to permit opening of the window to a greater degree while utilizing two of the bracket arms as mutually engaging stops. Anderberg's supporting bracket as depicted in FIG. 9 is indeed very useful. However, the structure thereof is fixed, thereby making installation and cleaning of the bracket difficult.

SUMMARY OF THE INVENTION

It is therefore a primary object of the present invention to mitigate and/or obviate the aforementioned drawbacks by providing a supporting bracket for windows, which is designed to be detachable so as to permit a convenient mounting and dismounting of the bracket to or from the window frame.

Another object of the present invention is to provide a supporting bracket having a stop which is turnable by simply using a coin or other suitable thin plate.

These and other objects and advantages of the present invention will become apparent to those skilled in the art upon reading the detailed description provided hereinbelow, with appropriate reference to the accompanying drawings.

DETAILED DESCRIPTION OF THE PREFERRED EMBODIMENT

Figure 1:
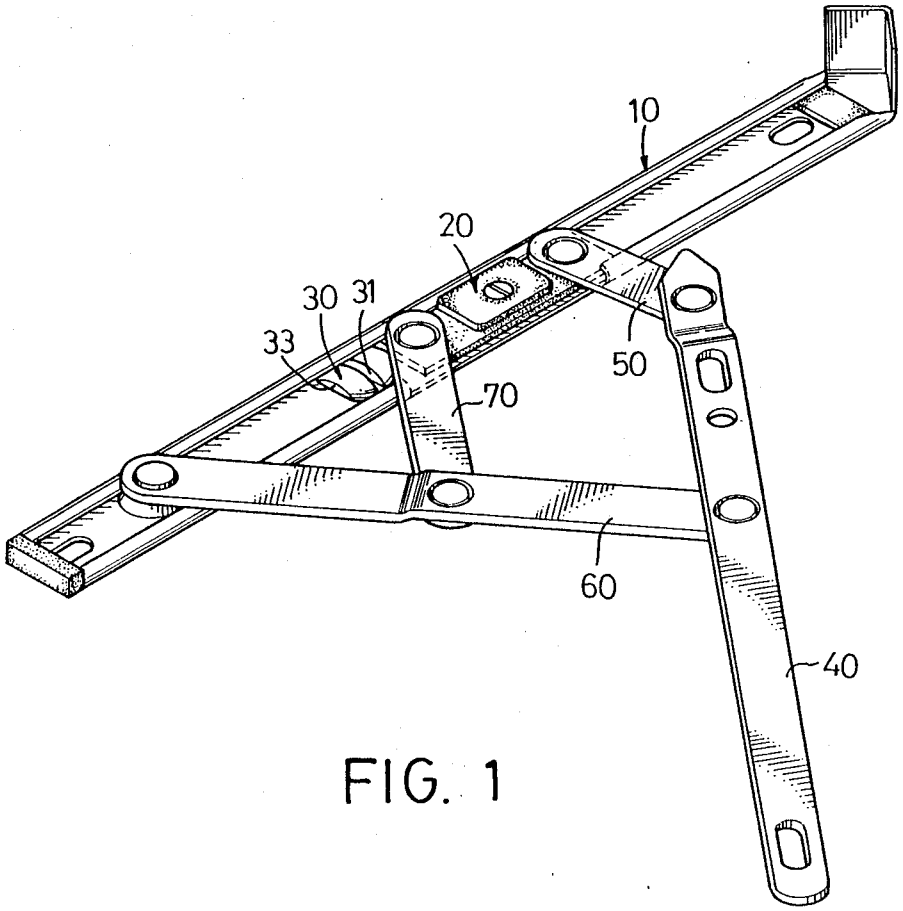
FIG. 1 is a perspective view of a supporting bracket for window in accordance with the present invention.

Referring to the drawings and initially to FIG. 1, each of the pair of the supporting brackets of the present invention used to support a window comprises a track member 10, a slide 20, a stop member 30, a sash arm 40, a short link 50, a strut 60, and a brace 70.

Figure 3:
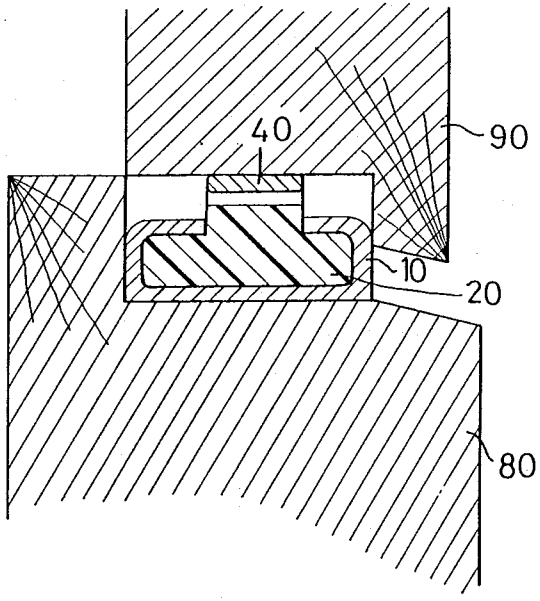
FIG. 3 is a partial sectional view illustrating the combination of the supporting bracket with the window frame and window sash.

The track member 10 is secured to the window frame 80 by any suitable means with one end of the track member 10 adjacent a corner of the window frame 80 and the sash arm 40 is secured to the window sash 90, as depicted in FIG. 3.

Figure 2:
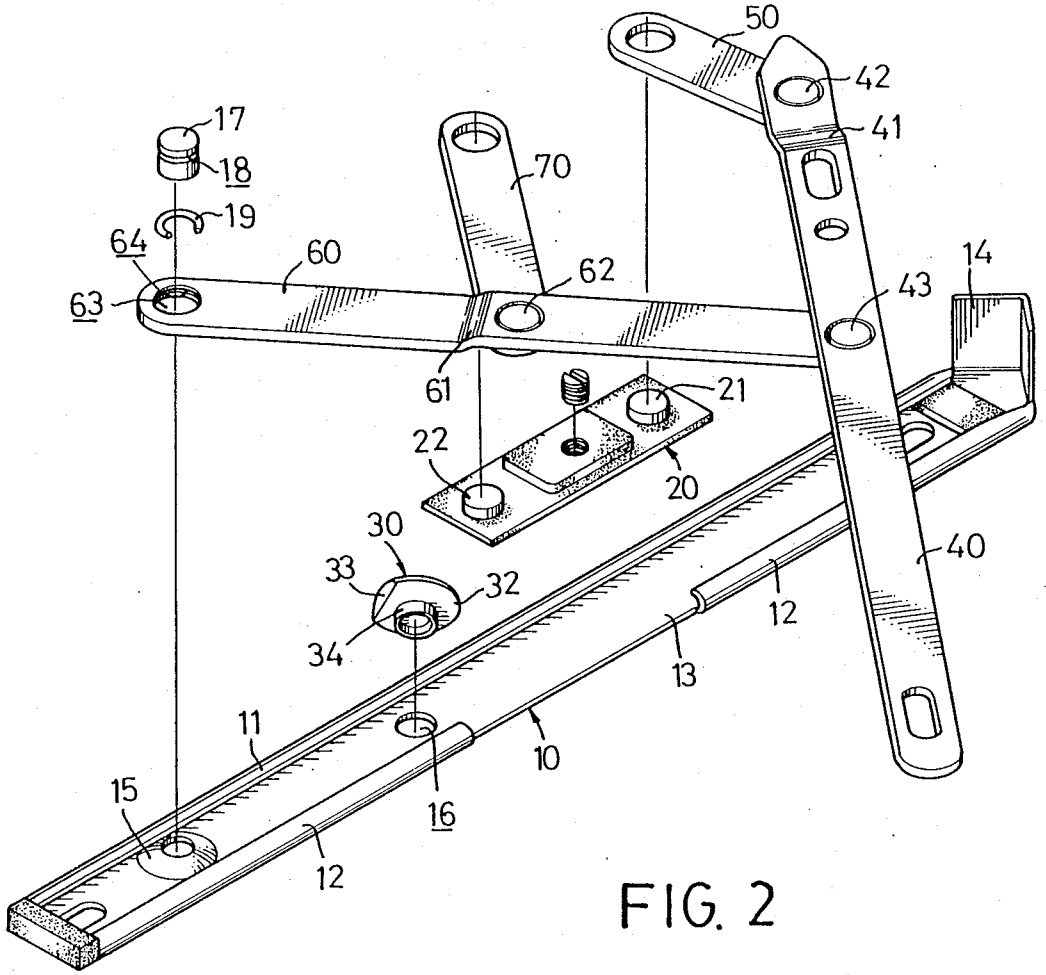
FIG. 2 is an exploded view of the supporting bracket shown in FIG. 1.
Figure 4:
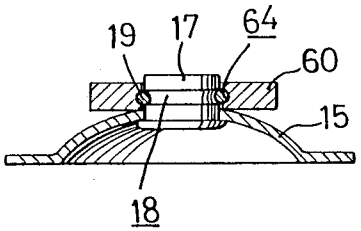
FIG. 4 is a partial sectional view illustrating the C-ring placement.

Referring to FIGS. 1 and 2, it can be seen that the track member 10 has a pair of folded side flanges 11 and 12 along its length each at one side thereof. The folded side flange 12 which is subject to face toward the window sash 90 in this case is discontinuous at a central part thereof so as to define a cutout part 13 for direct mounting and dismounting of the slide 20. In this embodiment, the side flange 12 is discontinuous at the central part of the track member 10. The length of the cutout part 13 is substantially the length of the slide 20. A cam member 14 with upright angularly related cam faces defining a truncated V is secured to the end of the track member 10 so as to make certain that the window sash 90 fits tightly against the window frame 80 when the window sash 90 is closed. The end of the track member 10 remote from the corner of the window frame 80, i.e., remote from the cam member 14, is provided with a raised boss 15 extending to a level flush with the upper surfaces of the side flanges 11 and 12. The track member 10 is further provided with a hole 16 for receiving the stop member 30 which will be described more fully hereinbelow. The boss 15 is provided with a pivot pin 17 having a central groove 18 and a C-ring 19 for joining the strut 60 (see FIG. 4).

Mounted on the track member 10 is a slide 20 having both sides fit under and are retained by the side flanges 11 and 12. The slide 20 is slidable between the end of the track member 10, adjacent the corner of a window frame 80 and a position near the opposite or extended end. The slide 20 is provided with two pivot pins 21 and 22 for joining the short link 50 and the brace 70 respectively.

Secured to the confronting side of the window sash 90 by screws is the sash arm 40. When the window sash 90 is in its closed position within the window frame 80, the sash arm 40 overlies or confronts the track member 10 with one end adjacent the end of the track member 10 disposed in the corner of the window frame 80. Near this end of the sash arm 40, there is provided a downward offset 41 and a first pivot pin 42.

The short link 50 is pivotally connected between the pivot pin 42 and the pivot pin 21 provided on top of the slide 20.

The sash arm 40 is provided with a second pivot pin 43. The strut 60 extends between the pivot pin 43 and the pivot pin 17 at the remote end of the track member 10.

A portion of the strut 60 is offset upwardly as indicated by 61. Within the length of the upwardly offset portion is a pivot pin 62. A brace 70 extends between the pivot pin 62 and the pivot pin 22 of the slide 20. The strut 60 is further provided with a hole 63 and a circular groove 64 formed at the sidewall around the hole 63 for combination with the pivot pin 17 of the track member 10.

Figure 5:
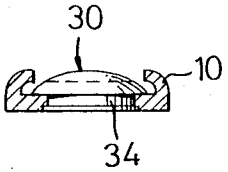
FIG. 5 is a sectional view illustrating the construction of the stop member.

Referring to FIGS. 1, 2 and 5, the stop member 30 is of a substantially button shape having a central groove 31 of a coin thickness. The stop member 30 has a rounded portion 32 and a flattened portion 33. The stop member 30 has an annular protuberance 34 at a lower face thereof so as to combine with the track member 10 through the hole 16.

Figure 6:
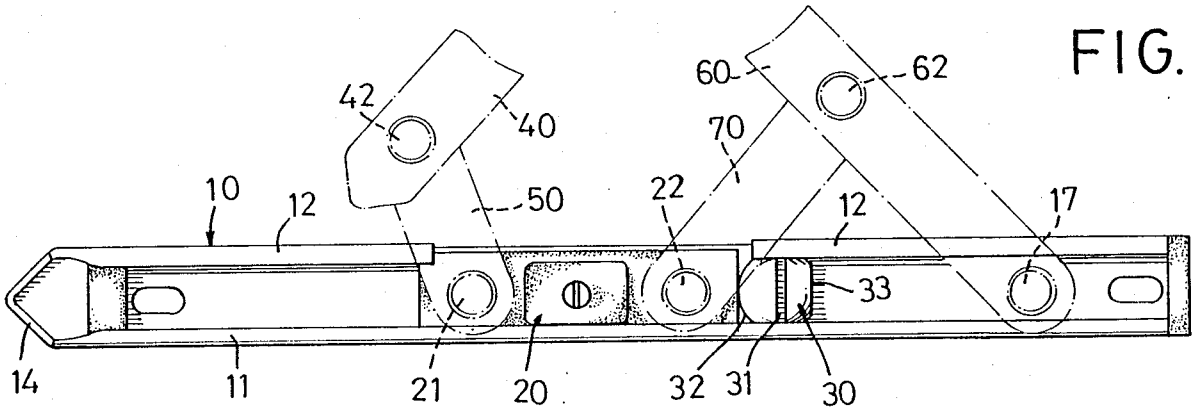
FIG. 6 is a fragmentary plan view of the supporting bracket illustrating the position of the slide when the stop member is located with its rounded portion facing the slide.

Referring to FIG. 6, it can be seen that when the stop member 30 is located with its rounded portion 32 facing the slide 20, the slide 20 remains within the side flanges 11 and 12 because the rounded portion 32 blocks the slide 20.

Figure 7:
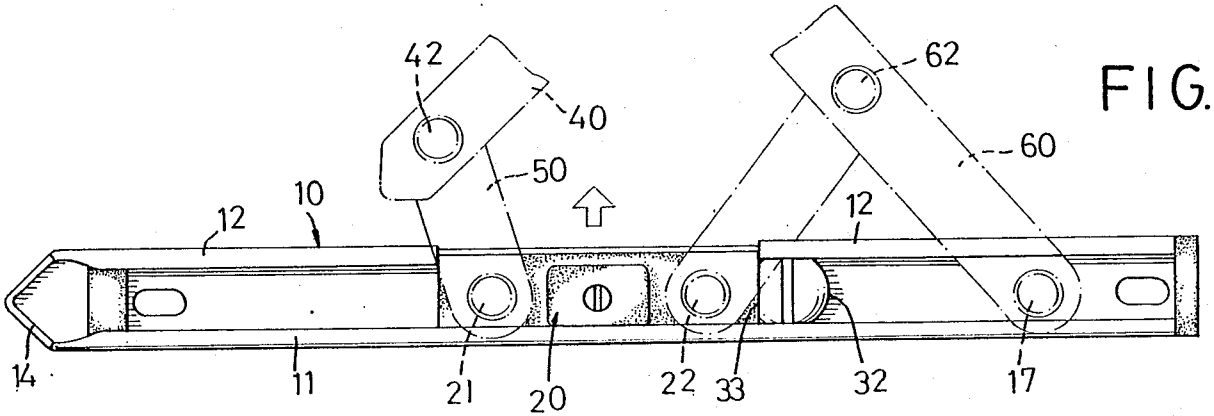
FIG. 7 is a fragmentary plan view of the supporting bracket illustrating the position of a slide when the stop member is located with its flattened portion facing the slide.

Referring next to FIG. 7, it is shown that when the stop member 30 is located with its flattened portion 33 facing the slide 20, the slide 20 is releasable from the track member 10 from the cutout part 13 in the direction as indicated by the arrow.

As mentioned previously, the strut 60 is detachable from the track member 10 with the use of C-ring 19, the sash arm 40, the link 50, the strut 60 and the brace 70 together with the slide 20 is therefore detachable from the track member 10. Accordingly, the track member 10 is readily washable or cleanable. Furthermore, the supporting bracket can be mounted or dismounted from a window frame readily for easy installation.

Figure 8:
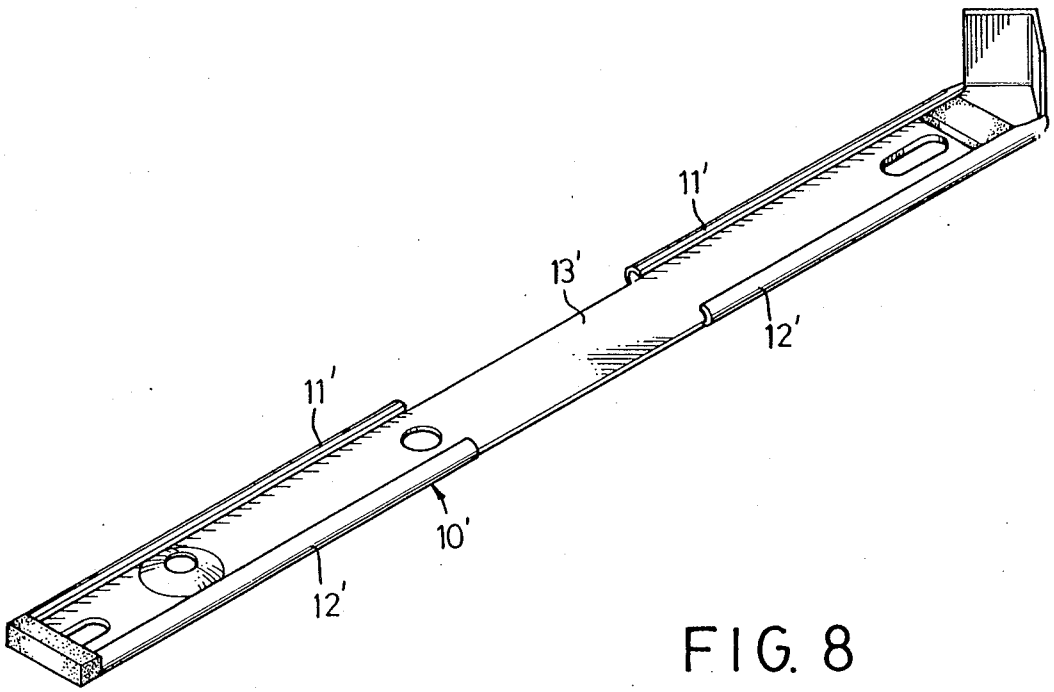
FIG. 8 is a perspective view of another embodiment of a track member of the supporting bracket for a window in accordance with the present invention.
Figure 9:
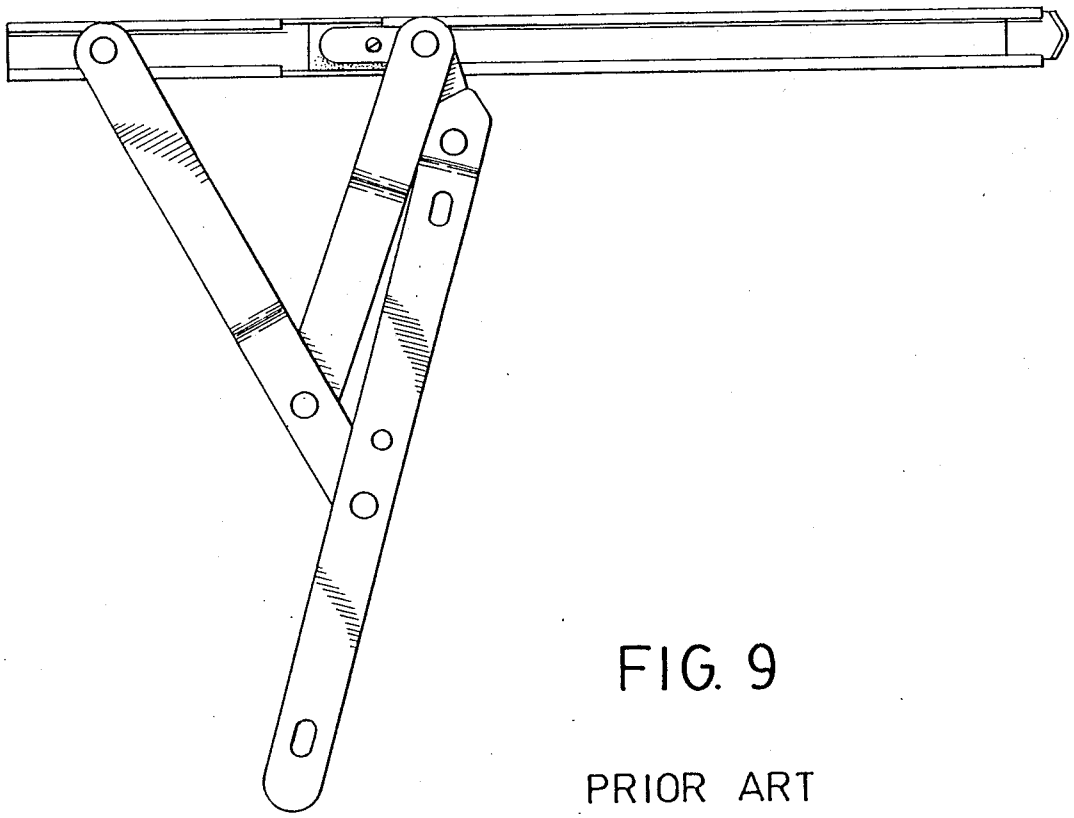
FIG. 9 PRIOR ART
FIG. 9 is a plan view of a conventional supporting bracket shown in its fully open position.

In another embodiment, the track member 10' as shown in FIG. 8, is constructed to comprise a pair of folded side flanges 11' and 12', wherein both of the folded side flanges 11' and 12' are discontinuous at the central part thereof to define a cutout part 13' which enables the slide 20 to be released therefrom at either side. This in turn enables the supporting bracket to be mounted at either end of a window frame 80 and window sash 90 without requiring the manufacture of "right" and "left" pairs.

While the present invention has been explained in relation to its preferred embodiment, it is to be understood that various modifications thereof will be apparent to those skilled in the art upon reading this specification. The invention disclosed herein is therefore intended to cover all such modifications as fall within the scope of the appended claims.

I claim:

1. A supporting bracket, comprising:

(a) a track member having a pair of folded side flanges along the length thereof with at least one of said folded side flanges which is subjected to face toward a window sash being discontinuous at a central part thereof to define a cutout part; and a boss provided with a pivot pin having a central groove and a C-ring;

(b) a slide movable along said track member; said slide having a length substantially equal to the length of said cutout part of said track member;

(c) a strut pivotally connected to said track member in spaced relation to said slide; said strut being detachable from said track member with the use of said C-ring;

(d) a brace pivotally connected to said slide and said strut;

(e) a link pivotally connected to said slide;

(f) a sash arm pivotally connected to said link and said strut; and (g) a stop member being substantially of a button shape having a central groove; said stop member having a rounded portion and a flattened portion; said stop member being turnable to a position with its rounded portion facing said slide to keep said slide within said folded side flanges and being turnable to a position with its flattened portion facing said slide such that said slide is releasable from said track member from said cutout part.

2. A supporting bracket as set forth in claim 1, wherein said track member has a pair of folded side flanges along the length thereof and both of said folded side flanges are discontinuous at a central part thereof to define a cutout part which enables the slide to be released therefrom at either side.

3. A supporting bracket as set forth in claim 1, wherein said central groove of said stop member is substantially of coin thickness.

* * * * *